United States Patent [19]

Bleick

[11] Patent Number: 4,646,602

[45] Date of Patent: Mar. 3, 1987

[54] CHEESE CUTTER

[76] Inventor: Robert O. Bleick, Rte. 2, Box 229, Cecil, Wis. 54111

[21] Appl. No.: 785,288

[22] Filed: Oct. 7, 1985

[51] Int. Cl.[4] ..... B26D 1/553

[52] U.S. Cl. ..... 83/408; 30/117; 83/425.4; 83/435.1; 83/437; 83/651.1

[58] Field of Search ..... 83/408, 425.4, 435.1, 83/437, 651.1; 38/116, 117

[56] References Cited

U.S. PATENT DOCUMENTS

| | | | |
|---|---|---|---|
| 164,400 | 6/1875 | Sieber | 83/408 |
| 874,133 | 12/1907 | Stevens | 83/651.1 X |
| 1,714,494 | 5/1929 | Case | 30/117 X |
| 2,611,404 | 9/1952 | Weeks | 83/408 |
| 3,088,186 | 5/1963 | Mennitt | 83/435.1 X |
| 3,277,574 | 10/1966 | Giasi | 83/651.1 |
| 4,195,402 | 4/1980 | Leffer | 83/651.1 X |
| 4,206,672 | 6/1980 | Smith | 83/435.1 X |
| 4,516,458 | 5/1985 | Pomerantz et al. | 83/651.1 |

*Primary Examiner*—Frank T. Yost

*Attorney, Agent, or Firm*—Recka, Joannes & Faller

[57] ABSTRACT

A cheese cutter for reducing a block of cheese by cutting the block in three perpendicular directions, comprising a frame, a carriage mounted and moveable linearly within the frame, low adherence, chemically inert cheese support members mounted on such carriage, means for moving the carriage within the frame, a stationary cutter having a plurality of cutting wires mounted therein, such cutting wires extending across the area through which the carriage is moved; and a pivoting cutter having a plurality of cutting wires mounted therein, pivotal through the area of travel of the carriage, together with a quick replacement cutting wire mounting system and various safety devices.

3 Claims, 6 Drawing Figures

CHEESE CUTTER

BACKGROUND OF INVENTION

1. Field of Art

The invention relates to bulk cheese cutters used in cheese stores and in small cheese packaging operations.

2. Prior Art

Bulk cheese is delivered in forty pound blocks. To reduce the blocks to consumer sizes, the blocks are cut by a knife or more commonly by a wire cutter. The cutting wire is mounted in a frame denominated a harp. In such a frame multiple wires are mounted, allowing more than one cut to be made with each pass of the harp through the cheese block.

As the number of cutting wires is increased, the force necessary to pass the cutting wires through the block increases. Hydraulic and electrical power are used in prior art to pass either a movable harp through a stationary block of cheese or to force the block of cheese through a stationary harp. Multiple cuts are made by changing direction of movement of the block.

Applicants device incorporates a reciprocally moving carriage, one stationary harp and one pivoting harp to cut a block of cheese in three perpendicular cuts, in a linear or straight line machine.

BRIEF SUMMARY OF THE INVENTION

The invention is a cheese cutter. The cutter comprises a stationary frame, on which is mounted a movable carriage: mounted on the carriage are vertical and horizontal cheese support members made of a non-toxic sterilizable material—support members are removable so they can be cleaned.

A block of cheese is mounted on cheese support members, the carriage is moved toward and through a stationary harp by driving means, in the least complex model this can be by a crank arm; other means can be used to move the carriage and the block of cheese mounted thereon through the stationary harp. One example is by means of a removable hydraulic cylinder.

Mounted in the stationary harp are a plurality of cutting wires.

The wires have retaining beads formed at each end. One beaded end is passed through a retaining slot and is retained by a saddle, the second passes through and is retained by a tension adjusting retainer. Mounted to the harps are plastic protection devices, the function of which is to prevent injury to a user if a wire breaks.

A number of wire retaining slots is provided. In use, some will have wires mounted therein, others not, depending on the desired size of the finished cut.

The carriage is moved by a crank arm to which a rope or cable is attached; the rope is affixed to the movable carriage. An adjustable stop stops the carriage under a second harp. The second harp comprises a plurality of wires mounted in a pivotally mounted frame. The second harp is used to cut the cheese in a direction perpendicular to the cuts made by the stationary harp.

The cutter wires and the frame opening in the pivoting cutter are longer and wider than the diagonal dimension of the cheese block.

It is difficult to make multiple cuts in a block of cheese. The wire cutters on the pivoting cutter enter the cheese block at an edge, angling across rather than flat across the cheese. Because of the point or edge contact of the wires with the cheese block, less force is needed than would be needed by starting a plurality of cuts across the flat surface of the cheese block.

Once started, the angled cut requires less force to continue; by addressing the cheese block at an angle with the cutting wire, it is possible to cut without power, other than the power provided by the operator. It is an object of the invention to manufacture a cutter that can be hand operated.

The frame must be strong enough to overcome torque from the cheese cutting. The pivoting frame is mounted so as to be held slightly beyond vertical when in the upright position to prevent inadvertent dropping of the pivoting cutter.

A stop is provided that holds the frame 10 degrees beyond vertical. A spring mounted ball plunger is forced into a slot in the vertical frame to assist in holding the pivoting cutter in a vertical position.

A safety "pin" can be placed to prevent movement of the pivoting frame. The pin will hold the frame vertical, horizontal or at a 45 degree angle.

Cutting wires are retained in the pivoting frame, as in the stationary frame, using retainer slots and tensioning devices; breakage safety devices, as are also found in the stationary frame, are provided.

The breakage safety device is a clear lexan plastic shield that is mounted so that it hangs over the cutter wire ends.

It is an object of the invention to make three perpendicular cuts of a block of cheese in a straight line machine to limit the space taken up by the machine.

It is an object of the invention to provide a low cost, easily cleanable, hand operated machine.

It is an object of the invention to provide a powerful force to cut the block, where the face of the block addresses the cutting wires squarely. Cuts perpendicular to the cut made by the stationary cutter are made by addressing the block at an edge. It is an object of the invention to use the natural crack propagation of the cheese to allow a lesser force to be applied to cut the cheese in a direction perpendicular to the first cuts.

BRIEF DESCRIPTION OF DRAWINGS

Drawing

Drawing

Drawing

Drawing

Drawing

Drawing

DETAILED DESCRIPTION OF INVENTION

Figure 1:
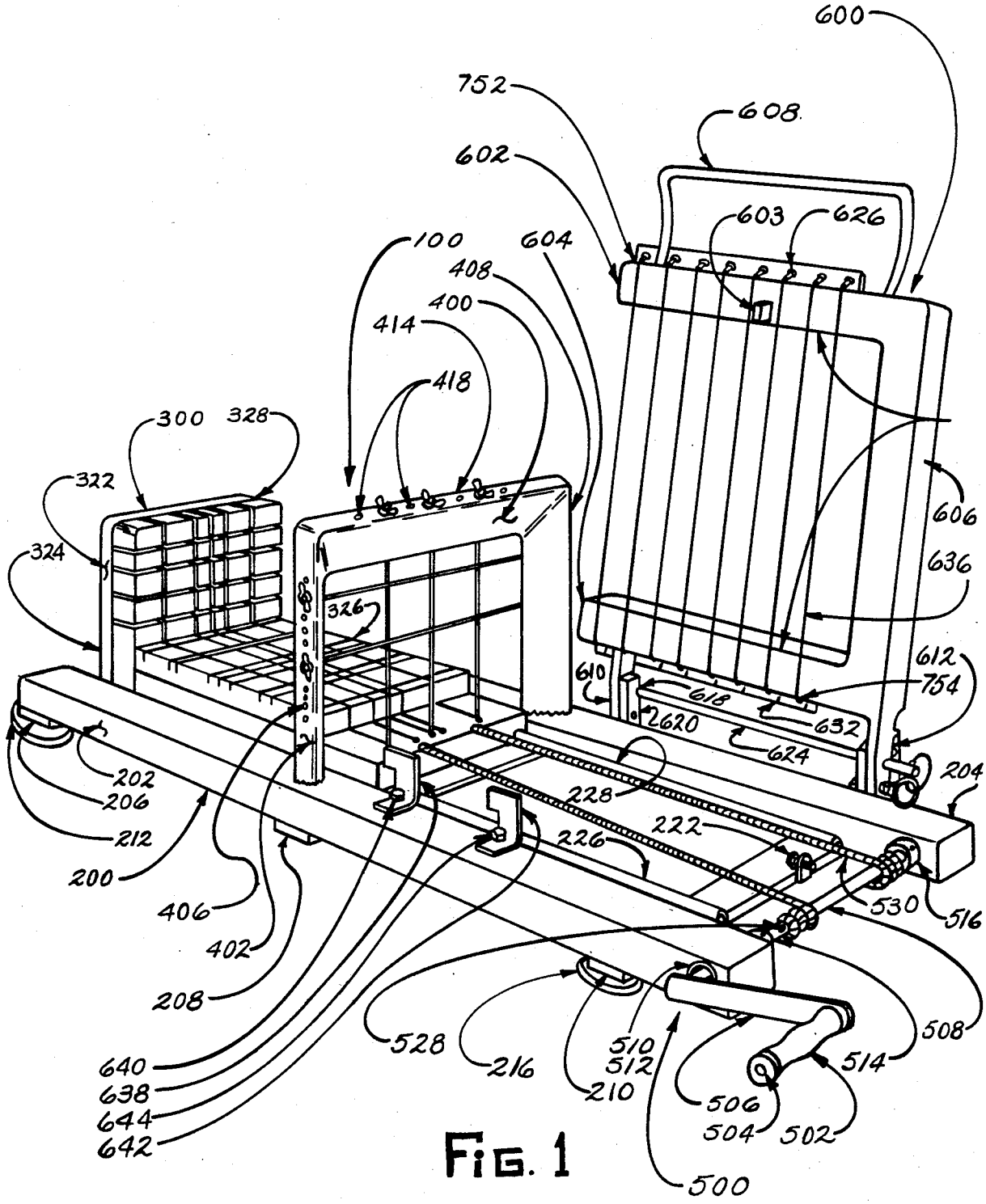
FIG. 1 is a perspective view of the device with pivoting harp raised.

The device includes the following parts:

100—Cheese Cutter
200—Frame
202—Frame longitudinal member
204—Frame longitudinal member
206—Frame cross member
208—Frame cross member
210—Frame cross member
212—Doughnut foot bolted to 206
214—Doughnut foot bolted to 206
216—Doughnut foot bolted to 210

218—Doughnut foot bolted to 210
220—Fixed carriage stop
222—Adjustable carriage stop
224—Stationary harp cutter wire support slots (in cross member 208)
225—Bead retaining saddles formed in the ends of the slots to hold the cutter wires
226—Carriage support rail
228—Carriage support rail
300—Carriage
302—Carriage support bearing
304—Carriage support bearing attachment bolt
306—Carriage support bearing support rail slot
308—Carriage support bearing
310—Carriage support bearing
312—Carriage support bearing
314—Carriage horizontal surface
316—Cutter wire slots in horizontal surface of carriage
318—Rope hole in horizontal surface
320—Rope hole in horizontal surface
322—Carriage vertical surface
324—Carriage vertical surface retaining sides
326—Cheese horizontal support members
328—Cheese vertical support member, rests on 326 and is kept on carriage by sides 324
400—Stationary harp
402—Stationary harp leg fixed to 202
406—Hanger holes
408—Stationary harp leg affixed to 204
410—Wire retainer slots in 408
414—Stationary harp horizontal member
418—Hanger hole in stationary harp horizontal member
420—Opening in stationary harp
500—Drive mechanism
502—Handle
504—Handle retaining bolt
506—Arm
508—Shaft
510—Shaft bearing
512—Shaft bearing support
514—Retainer collar
516—Retainer collar
518—Shaft bearing
520—Shaft bearing support
522—Rope hole
524—Rope retainer screw
526—Rope hole
528—Rope retainer screw
530—Rope
600—Pivoting harp
602—Pivoting harp upper horizontal member
603—Stop
604—Pivoting harp lower horizontal member
606—Pivoting harp vertical member
608—Handle
610—Pivoting harp mounting extension
611—Pivoting harp mounting extension pivot hole
612—Pivoting harp mounting extension
613—Pivoting harp mounting extension pivot hole
616—Frame to harp mounting leg
618—Mounting leg pivot hole
620—Frame to harp mounting leg
622—Mounting leg pivot hole
624—Pivot rod
626—Pivoting harp hanger holes
632—Wire retaining slots
636—Cutter wires in pivoting harp
638—Adjustable cheese side support
640—Adjustable cheese side support stud
642—Adjustable cheese support
644—Adjustable cheese support stud
700—Cutter retaining system
702—Wire
704—Wire bead
706—Wire bead
710—Bead retainer saddle
712—Hanger hole (elliptical or square)
714—Hanger
716—Hanger bolt
718—Hanger bolt flat
720—Hanger bolt flat
722—Hanger bolt tensioning wing nut
724—Slot in screw to pass wire
726—Bead support saddle in hanger bolt
728—Scale on vertical leg
730—Radius surface
732—Wire locator slot, corresponding scale number
734—Wire locator slot, corresponding scale number
736—Radius edge
738—Scale on vertical leg
740—Scale on horizontal leg
742—Radius edge
744—Wire location slots corresponding to scale number
746—Scale, pivoting harp upper horizontal member
747—Scale, pivoting harp lower horizontal member
752—Wire location groove
754—Wire locator groove
756—Radius edge
758—Bead retainer saddle
800—Safety devices
802—Safety shield attached to 402 by shield retainers
804—Shield retainer
806—Shield retainer
808—Safety shield attached to 414 by shield retainers
810—Shield retainer
812—Shield retainer
814—Safety shield attached to 604 by shield retainers
816—Shield retainer
818—Shield retainer
820—Safety shield attached to 602 by shield retainers
822—Shield retainer
824—Shield retainer
850—Locking hole in pivoting harp mounting extension 612
852—Locking hole in frame to harp mounting leg
854—Locking hole in frame to harp mounting leg
858—Locking pin
860—Locking pin retaining cable
862—Locking pin retaining cable hole
864—Ball plunger mounted in 610
866—Ball plunger spring
868—Ball plunger retainer hole
870—Ball stop

FRAME SERIES

The cheese cutter shown in FIG. 1, comprises a frame 200, made up of frame longitudinal members 202 and 204, attached to frame cross members 206, 208 and 210.

Rubber doughnut feet 212, 214, 216 and 218 are bolted to each end of the cross members 206 and 210.

Attached to and extending upward from cross member 206 is fixed carriage stop 220 not shown. Attached to and extending upward from cross member 210 is adjustable carriage stop 222.

Cross member 208 is slotted to provide cutter wire support slots 224. Those slots can best be seen in FIG. 3. Bead retaining saddles 225 are formed in the end of the slots to hold the cutter wires.

Carriage support rails 226 and 228 are affixed to cross members 206, 208 and 210.

Carriage 300 is mounted on rails 226 and 228 and is moveable back and forth on those rails in the space limited by fixed stop 220 and adjustable stop 222.

CARRIAGE SERIES

The carriage is supported on the rails by carriage support bearings 302, 308, 310 and 312. Mounted at the four corners of carriage 300. The bearings are of a low friction material and are slotted 306 to drop over rails 226 and 228 so the carriage can be lifted off the rails to be cleaned. Two of the bearings 302 and 308 can be seen in FIG. 2.

Bearings are attached to the carriage by bolts 304.

Figure 2:
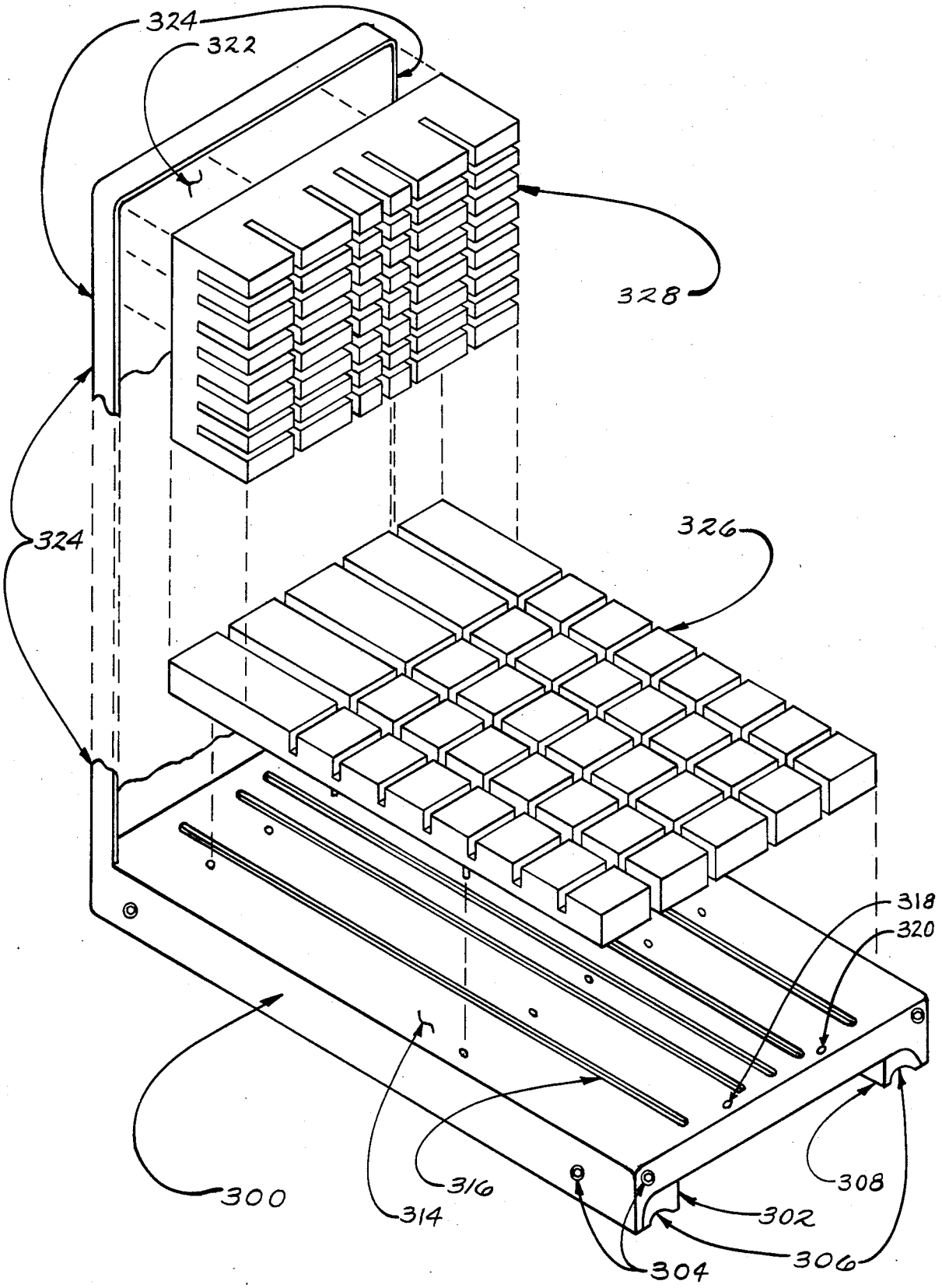
FIG. 2 is a view of the removable cheese support surfaces.

The carriage has a horizontal surface 314 and a vertical surface 322. The horizontal surface 314 is slotted with parallel slots 316 to allow passage of the carriage past the vertical cutter wires mounted to the frame and to the top of the fixed harp, as the carriage is moved back and forth on the rails. The carriage is best shown in FIG. 2.

The horizontal surface 314 also has a pair of holes 318 and 320 to attach a drive rope. The holes on the horizontal surface effect a moment arm to exert torque to hold the carriage down on its bearings as the carriage is pulled forward and is torqued upward by the force of the wires cutting the cheese block.

The vertical surface 322 has sides 324 extending outward to retain vertical cheese support 328. Vertical cheese support 328 is a slotted block of a chemically and physiologically inert material. The horizontal surface 314 supports several blocks of the same material 326.

The horizontal cheese support member comprises several slotted blocks. The number of blocks is determined by the size of cheese blocks desired.

STATIONARY HARP SERIES

Figure 3:
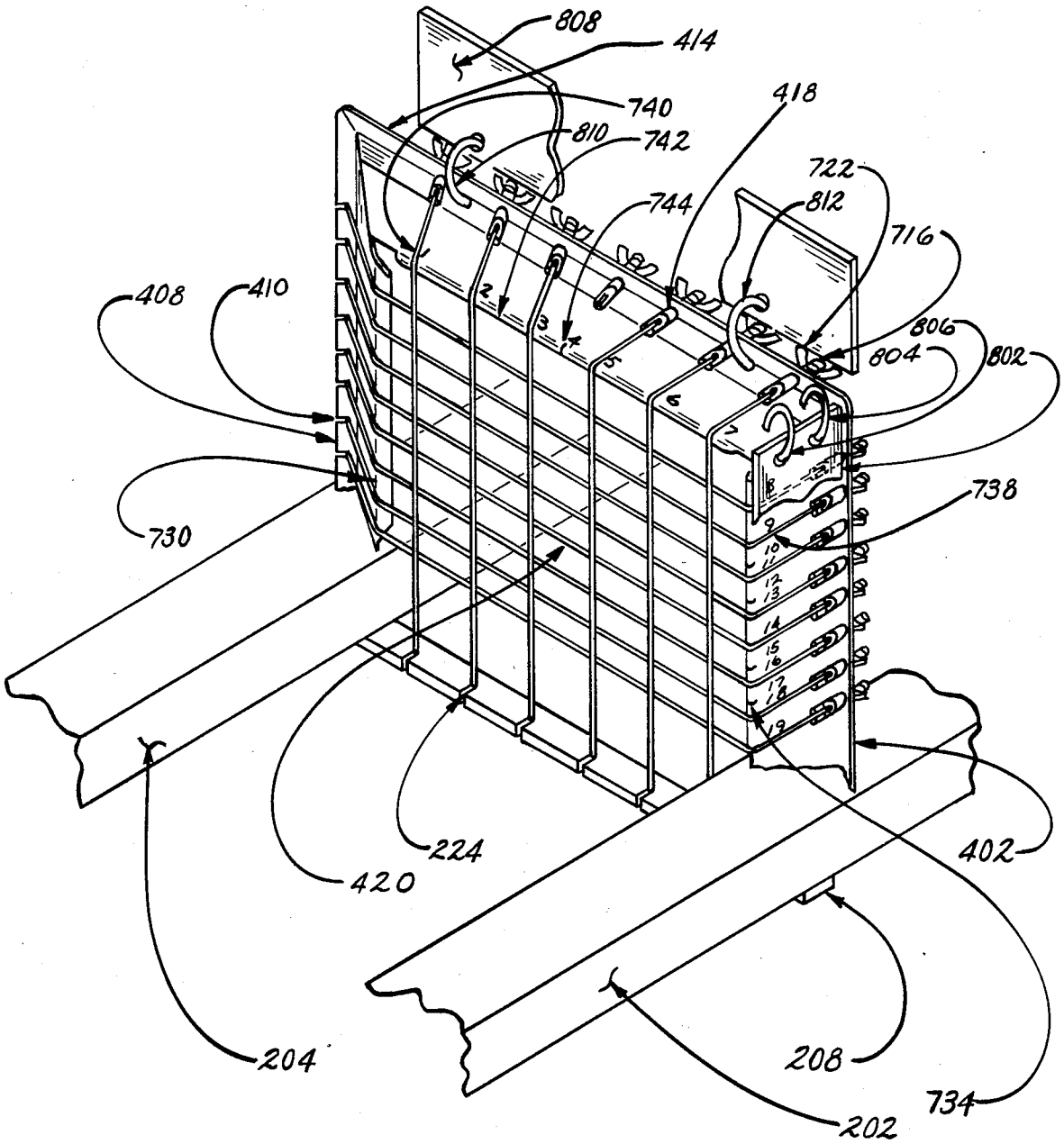
FIG. 3 is a view of the stationary harp.

Stationary harp 400 comprises leg 402 affixed to frame member 202, leg 408 affixed to frame member 204, and horizontal member 414 which is affixes to 402 and 408 to form a bridge over the frame. The stationary harp is best shown in FIG. 3.

Wire hanger holes 406 and 418 are formed in 402 and in 414. Wire retainer slots 410 are formed in 408.

Wires supported between the horizontal and vertical member of the stationary harp cut the cheese block as the carriage is pulled through the opening in the harp. The details of mounting of the cutting wires and means to vary the size of cuts by varying location of wires is discussed further in the specification.

DRIVE MECHANISM

The carriage drive mechanism 500 shown in FIG. 1, comprises a handle 502, handle retaining bolt 504, attached to lever arm 506. Arm 506 serves to rotate shaft 508. Shaft 508 is mounted through frame longitudinal members 202 and 204. Bearing supports 512 and 520 support shaft bearing 510 and 518. Retainer collars 514 and 516 retain bearings and shaft in the frame.

A nylon rope 530 is attached to shaft 508 and to carriage 300. Holes 522 and 526 in the shaft, together with retainer screws 524 and 528 retain the rope at the shaft end. The rope is retained in the carriage by carriage bolts 318 and 320.

PIVOTING HARP

Figure 5:
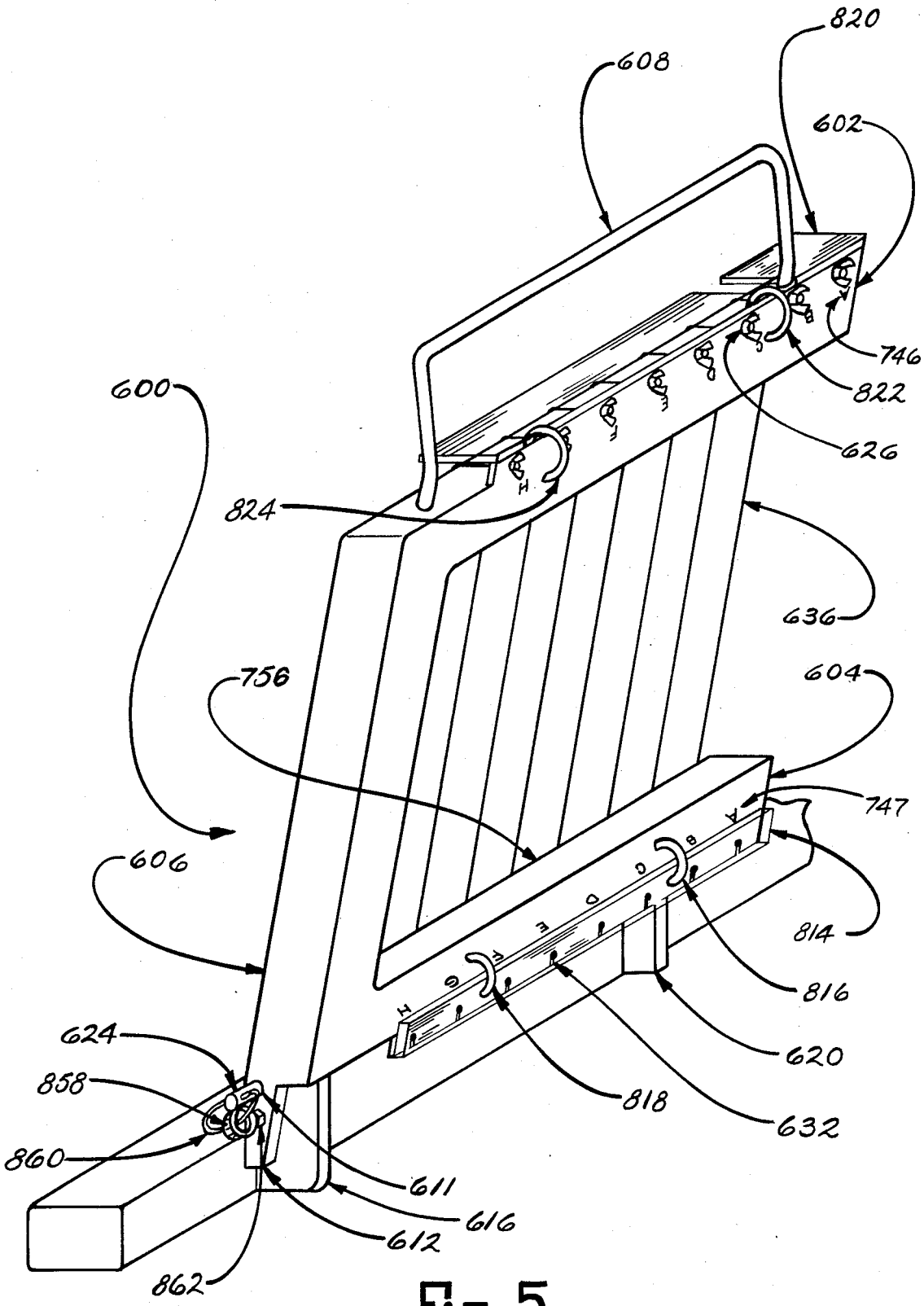
FIG. 5 is a back view of the pivoting harp showing cutting wire mounting and mounting of pivoting harp to frame of device.

A pivoting harp 600, shaped like the letter U comprising horizontal members 602 and 604 and vertical members 606 is pivotally mounted to the frame, at longitudinal member 204. This is shown in FIG. 5.

Handle 608 is attached to horizontal member 602. Stop 603 is attached to horizontal member 602.

At the bottom of harp 600, extending from horizontal member 604, are mounting extensions 610 and 612.

Extending upward from longitudinal member 204 are mounting legs 616 and 620.

Pivot holes 611 and 613 in the harp and pivot holes 618 and 622 pass pivot rod 624. The harp then can pivot across the area of travel of the moveable carriage.

Hanger holes 626 are formed in horizontal member 602.

Cutter wires in pivoting harp 636, are retained by hangers, located in hanger holes 626. The cutter wire passes over two radius surfaces and is held at the bottom by slot 632. Both radius surfaces are grooved to precisely locate the cutter wire.

As the pivoting harp and its cutter wires are passed through a block of cheese, the block is forced outward. To limit this outward movement adjustable cheese side supports 638 and 642 are mounted on longitudinal member 202. Adjustment of the cheese side supports is by means of a stud and nut, 640 and 642.

WIRE CUTTER

The wire retaining system and the system for setting the cutter for the desired size of pieces to be cut comprise the following elements.

Figure 4:
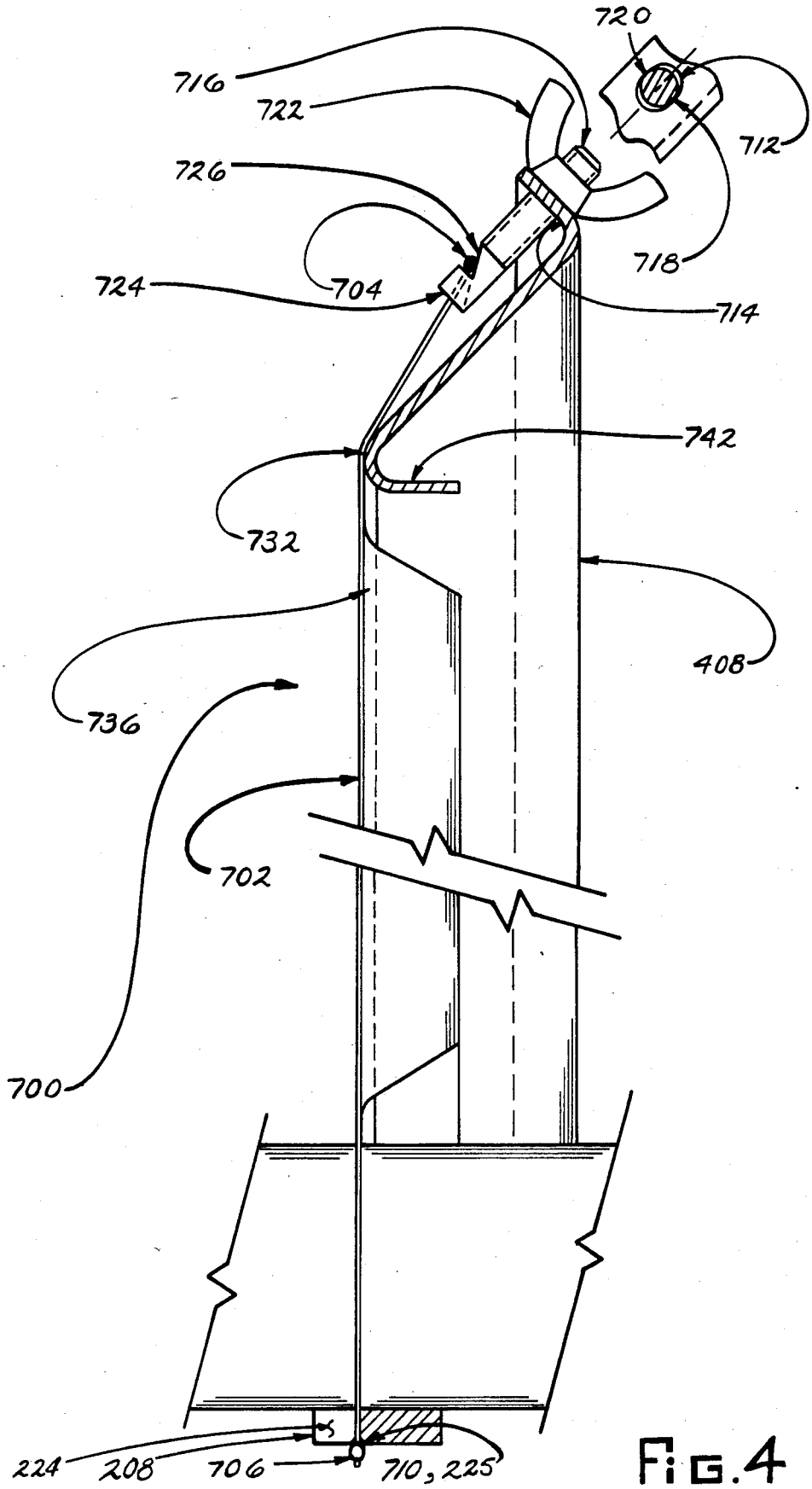
FIG. 4 is a view of the cutter wire showing mounting and tensioning means.

Cutter wire 702 is a stainless steel wire. At both ends a bead 704 or 706 is formed on the wire. This is shown in FIG. 4.

Cutter wire 702 with its two beads 704 and 706 passes through slot 224 at one end and by hanger 714 at the other. Slot 224 is wide enought to pass the wire into the slot. To retain bead and wire, a saddle or depression 710 is formed at the end of slot 224 to retain the bead and its attached wire.

Hanger 714 comprises a hanger bolt 716 and a tensioning wing nut 722. Hanger bolt 716 is flattened on two opposing sides. Hanger hole 712 is elliptical. The shape of the hole prevents the hanger bolt from rotating as wing nut 722, at the end of the bolt, is turned to tension the cutter wire as is best seen in FIG. 4.

Slot 724 is formed lengthwise in hanger bolt 716 to pass the cutter wire to support saddle 726 to hold the bead and thereby the cutter wire.

Cutter wires on both stationary harp and pivoting harp extend over a pair of radius edges. Such radius edges greatly reduce cutter wire breakage. In one wire mounting position there is only one radius edge; that is the vertically mounted wires on the stationary harp. The wire held by cross member 208 does not pass over a radius edge. On the radius edge on each harp are wire indexing grooves.

The grooves precisely locate cutting wires. Each groove is numbered or lettered as shown in FIG. 3 and in FIG. 5. Size indexing numbers 738 appear as a scale on legs 402 and 408. Wire locator groove 732 is formed on radius surface 730. These locator grooves are not equidistant. For example, a hanger mounted in a hanger hole can retain a wire in any one of several closely located locator grooves.

On the opposite side of the stationary harp on leg 402 is scale 738 corresponding to grooves 734 formed in radius edge 736 as best seen in FIG. 3.

On the horizontal surface of the stationary scale 740 is marked. That scale corresponds to locator grooves 744 formed in radius edge 742.

The pivoting harp scales 746 and 747 can be read when the harp is horizontal. Those scales are alphabetically marked as can be seen in FIG. 5. The cutter wire on the pivoting harp extends from wire locator groove 752 on radius edge 756 to groove 754 formed on 756.

Over each wire retaining surface is mounted a clear plastic safety shield. The shield prevents throwing of a bead and lashing out of wire. Shield 802 is attached to leg 402 by retainers 804 and 806; shield 808 is attached to horizontal member 414 by retainers 810 and 812. Shield 814 is attached to 604 by retainers 816 and 818 and shield 820 to leg 602 by retainers 822 and 824.

The pivoting harp is mounted so as to be held 10 degrees back from vertical or 100 degrees from horizontal. Mounting extensions 610 and 612 bear on frame member 204 to keep the harp from going back beyond approximately 100 degrees.

Figure 6:
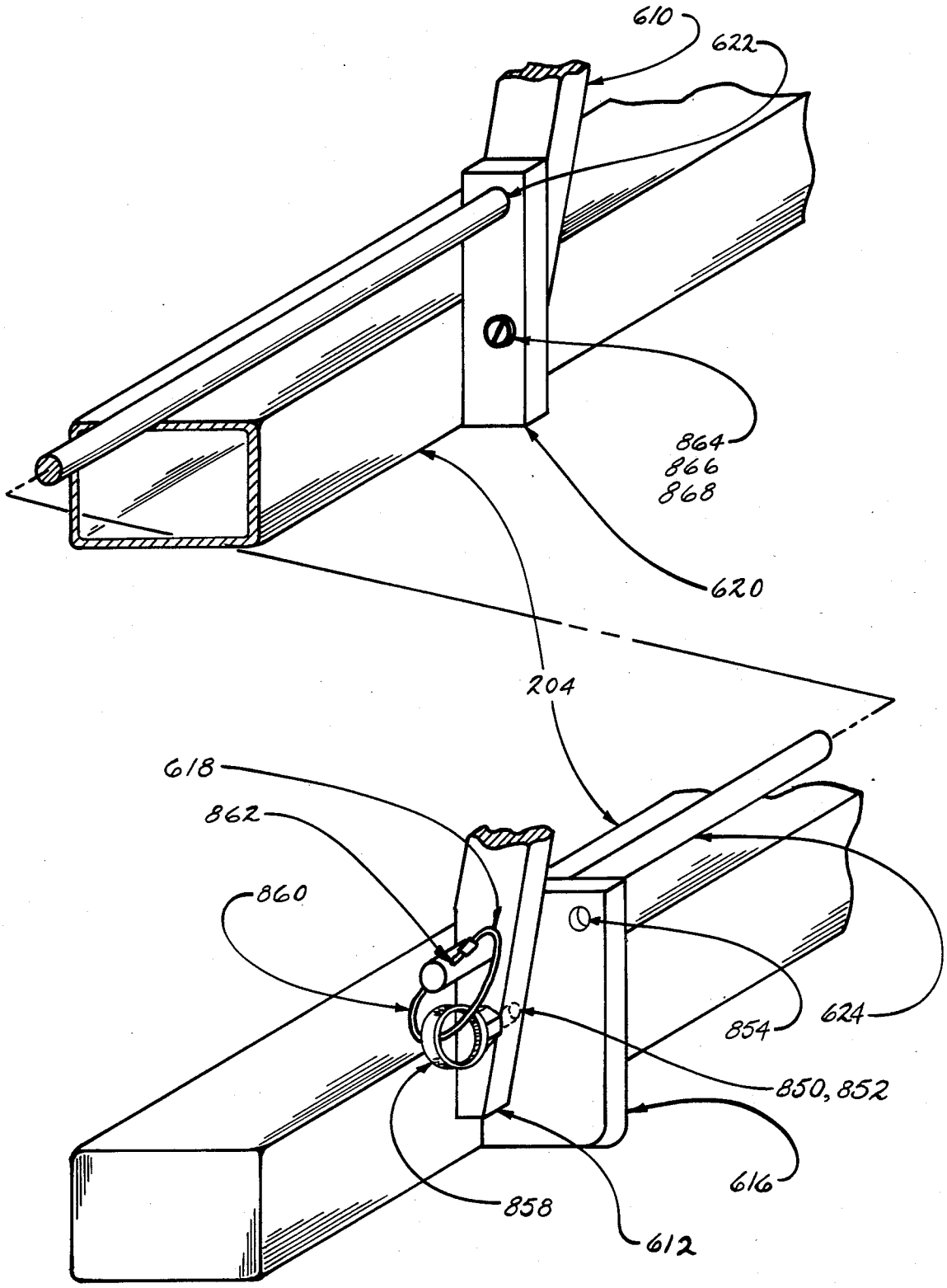
FIG. 6 is an expanded view of the mounting area of the pivoting harp showing safety devices.

Ball plunger 864 mounted in the frame extension and urged outwardly by spring 866, while retained in hole 868 is forced into ball stop 870 not shown in the drawings. The retainer screw for ball plunger 864 can be seen in FIG. 6. The ball plunger provides further force to prevent unwanted dropping of the pivoting harp.

The pivoting harp can be locked so that it may not pivot. The can be locked in three positions: upright, down, and at a 45 degree angle.

A hole in mounting extension 612 corresponds to one of two holes: 852 and 854. Locking pin 858 is attached to pivot rod 624 by cable 860 and retained in cable hole 862.

BEST METHOD

The dimensions of the standard 40 pound nominal weight block of cheese are seven inches high eleven inches across and fourteen inches long. These are nominal dimensions. Wire locator grooves and hangers are mounted so as to correlate with numbered and lettered scales on the stationary and pivoting harps. Spacing of the wires can be determined mathematically to cut the desired sizes.

The cheese support blocks are made of ultra high molecular weight polyethelene. The material is chemically and physiologically inert, of low adherence to the cheese being cut and of low moisture absorption so that it can be cleaned and sterilized by means found in small shops.

Other materials having the properties of low adherence to cheese, low moisture absorption and chemically and physiologically inert may also be used as support blocks.

The safety shields have been made of "LEXAN", a clear easily machined plastic. The device itself is made of various strengths and thicknesses of stainless steel.

I claim:

1. I claim:

a cheese cutter for cutting a block of cheese into smaller rectangular blocks comprising;

a rectilinear frame;

support rails mounted within the internal perimeter of the frame, parallel with the longest dimension of the frame;

a moveable carriage, mounted within the frame, on such support rails, moveable linearly back and forth within the frame, on such rails; such moveable carriage having slots formed therethrough, the slots being parallel with the longest dimension of the frame such slots allow a block of cheese mounted on the carriage to be forced through vertical cutting wires;

cheese support members, removeably attached to the moveable carriage, such cheese support members being made of a material with the properties of low moisture absorption, low adherence to cheese and being chemically and physiologically inert;

means for moving the carriage, linearly back and forth on the support rails, within the area defined by the frame; wherein such means comprises a crank arm attached to a drive shaft, such drive shaft being journaled into the frame; a cable attached to the shaft, such cable being attached to the moveable carriage, whereby rotating the drive shaft draws the moveable carriage along the rails;

a stationary harp, extending over, and bridging the rectilinear frame; the height of opening of such harp being higher than the height of the block to be cut, the width of opening of such harp being wider than the width of the cheese block to be cut;

a plurality of cutting wires affixed to such stationary harp, extending vertically and horizontally across the area through which the carriage is moved;

a pivoting harp affixed to the frame, such harp being of U shape, the legs of the U being wider than the block of cheese to be cut, the base of such U being larger than the diagonal measure of the block to be cut; such harp being pivotal through the area through which the carriage is moved;

a plurality of cutting wires affixed to such pivoting harp.

2. The cheese cutter claimed in claim 1, further comprising:

a plurality of safety shield hingedly mounted over the ends of the cutting wires to prevent throwing of mounting beads.

3. The cheese cutter claimed in claim 1 further comprising:

low friction carriage support bearings mounted at the four corners of the moveable carriage, such carriage support bearins having grooves formed therein to partially encompass the carriage support rails, whereby the carriage while supported in its movement back and forth on the rails, may be readily detached for cleaning.

* * * * *